US008419663B2

(12) United States Patent
Eitzen

(10) Patent No.: US 8,419,663 B2
(45) Date of Patent: Apr. 16, 2013

(54) MASSAGER

(76) Inventor: Gary Donald Eitzen, Calgary (CA)

( * ) Notice: Subject to any disclaimer, the term of this patent is extended or adjusted under 35 U.S.C. 154(b) by 701 days.

(21) Appl. No.: 12/458,006

(22) Filed: Jun. 29, 2009

(65) Prior Publication Data

US 2010/0331744 A1 Dec. 30, 2010

(51) Int. Cl.
*A61H 7/00* (2006.01)

(52) U.S. Cl.
USPC ..... 601/84; 601/136

(58) Field of Classification Search ..... 601/118, 601/120, 121, 125, 133–135, 84; 482/126, 482/148
See application file for complete search history.

(56) References Cited

U.S. PATENT DOCUMENTS

| | | | | |
|---|---|---|---|---|
| 718,594 | A | 1/1903 | Bailey | |
| 2,168,975 | A | 8/1939 | Clarke | |
| 4,493,315 | A * | 1/1985 | Iwahashi | 601/135 |
| 5,730,708 | A * | 3/1998 | Spratt | 601/118 |
| 6,241,693 | B1 * | 6/2001 | Lambden | 601/15 |
| 7,291,101 | B2 * | 11/2007 | Deal | 482/126 |
| 7,335,171 | B2 | 2/2008 | Ewel et al. | |
| 2006/0142675 | A1 * | 6/2006 | Sargent | 601/70 |
| 2006/0211961 | A1 * | 9/2006 | Meyer et al. | 601/73 |

* cited by examiner

*Primary Examiner* — Michael Brown

(57) ABSTRACT

Disclosed is an apparatus for massaging the body of a user comprising an arcuate member extending between first and second opposed ends and a central portion therebetween. The first and second ends are oriented away from the central portion and the arcuate member defines an arc having an angle of less than 180 degrees. The apparatus further comprises gripping portions disposed at the first and second opposed ends and a therapy applicator connectable to the central portion.

14 Claims, 12 Drawing Sheets

MASSAGER

BACKGROUND OF THE INVENTION

1. Field of Invention

The present invention relates to massagers in general and in particular to a method and apparatus for massage a user.

2. Description of Related Art

Individuals who spend long hours working with computers or driving can be prone to muscle tension and discomfort building up in and around their shoulder blades. This is due to the long periods of abnormal arm position. It is also very common for construction personnel and people who perform repetitive arm work to find a build up of muscle strain and tension in these areas. Common methods of relieving this type of stress may include muscle relaxants, massage or chiropractic adjustments. However, many of these methods may not be convenient for a user or may be expensive for treatments to be administered by a massage or chiropractic professional.

Previously, self-massage has also not been practical. Current equipment for self-massage has not been adequate to provide the necessary pressure and/or leverage to help relieve this type of tension. In particular, previous apparatuses have not provided the combination of leverage, heat, light-therapy and vibration capabilities available to them for self massage units. Pervious apparatuses have also not been able to compensate for different arm lengths.

In particular, applicant is aware of U.S. Pat. No. 6,241,693 to Lambden discloses a method and apparatus for applying pressure to the body of a person. In use, the device disclosed in Lambden positions the arms away from the body of the user and close together which will causes the arm muscles to tire quickly and may actually increase the tension between the shoulders. The closed position of the handles of the Lambden device may also limit the positions in which the device may apply pressure to the body of the user.

Similarly, U.S. Pat. No. 5,730,708 to Sprat discloses a massager for the back portion of the human body. The device disclosed in Sprat has no mechanism to deliver heat or vibration to the user. Additionally, the hinge in the center of the device of Sprat may decrease the possible pressure that the user may apply to their muscles and may cause areas of the body to be pinched therebetween.

As disclosed by U.S. Pat. No. 7,335,171 to Ewell et al. discloses a cane adapted to provide pain relief. The apparatus of Ewell et al. does not provide vibration and may be difficult to move around on the back of a user for a massage due to limited locations on which to grasp the apparatus. Furthermore, gripping both ends of the apparatus of Ewell et al. on the same side of the body may cause further strain on the user thereby adding to the back tension and discomfort of the user.

The device disclosed by U.S. Pat. No. 4,493,315 to Iwahashi has no mechanism to deliver heat or vibration and Its ability to deliver pressure is hampered by the bendable center and straight design. Similarly, the device disclosed by U.S. Pat. No. 2,168,975 to Clarke also has no mechanism to deliver heat or vibration. The central hinge mechanism of the Clarke device also minimizes the ability to move the unit in both vertical and horizontal plains. U.S. Pat. No. 718,594 to Baily also has no mechanism to deliver heat or vibration. The Baily device is also not designed to deliver a single pressure point and can only be rolled in a single plain for each arm position.

SUMMARY OF THE INVENTION

According to a first embodiment of the present invention there is disclosed an apparatus for massaging the body of a user. The apparatus comprises an arcuate member extending between first and second opposed ends and a central portion therebetween. The first and second ends are oriented away from the central portion and the arcuate member defines an arc having an angle of less than 180 degrees. The apparatus further comprises gripping portions disposed at the first and second opposed ends and a therapy applicator connectable to the central portion.

The arcuate member may comprise an arcuate member having a rectangular cross-section. The arcuate member may be bow shaped. The gripping may comprise handles selectably connectable to the first and second ends. The handles may extend axially from the first and second ends. The handles may be rotatably connectable to the first and second ends. The handles may be ring shaped. The first and second ends may have bores therein wherein the handles have shafts extending therefrom receivable within the bores. The handles may be proximate to the first and second ends when the shafts are secured within the bores. The shafts may extend the handles away from the first and second ends.

The pressure applicator may comprise a cartridge selectably securable to the central portion. The cartridge may be operable to apply at least one of heat, vibration and light to the body of a user. The cartridge may include an electric heater. The cartridge may include an electrically driven vibrator. The cartridge may include at least one light emitting diode.

The arcuate member may include a latching mechanism at the central portion operable to cooperate with a corresponding latch on the cartridge. The arcuate member may include a power supply wherein the latching mechanism includes electrical contacts for transmitting electrical current between the power supply and the cartridge. The latching mechanism may comprise a rotatable latch. The cartridge may include a plurality of rollers disposed for contact with the body of a user.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In drawings which illustrate embodiments of the invention wherein similar characters of reference denote corresponding parts in each view.

DETAILED DESCRIPTION

Figure 1:
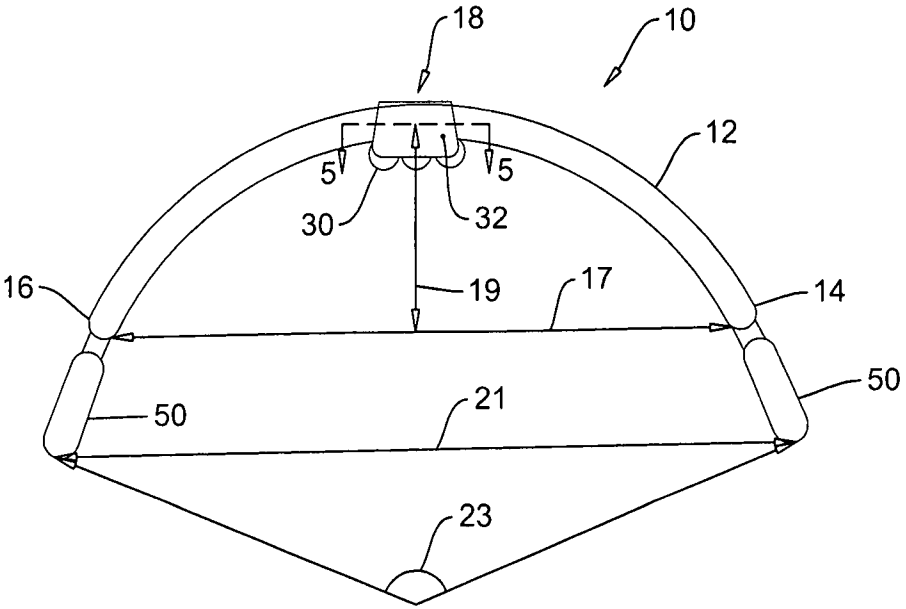
FIG. 1 is a side view of an apparatus for massaging the body of a user according to a first embodiment.
Figure 2:
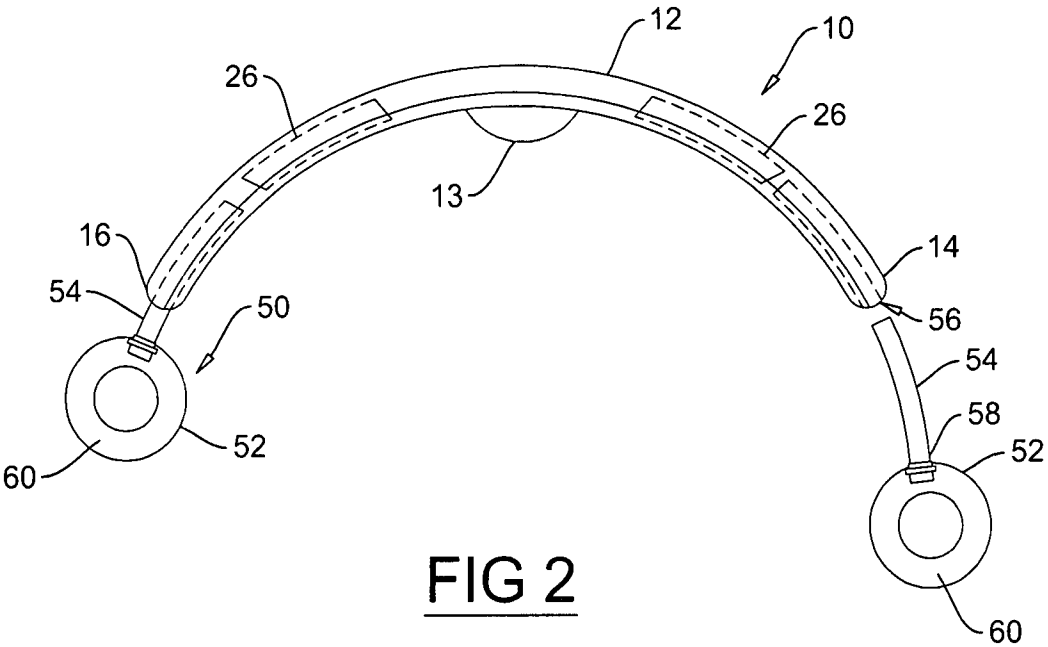
FIG. 2 is a side view of an apparatus for massaging the body of a user having detachable handles and a permanent massage point according to a further embodiment.

Referring to FIG. 1, an apparatus for massaging a body part of a user according to a first embodiment of the invention is shown generally at 10. The apparatus 10 comprises an elongate arcuate member 12 having first and second opposed ends, 14 and 16, respectively, and a central portion 18 therebetween. The apparatus further includes a therapy applicator 30 as and handles 50 disposed at the first and second ends 14 and 16 will be further described below. The apparatus 10 may be a one-piece solid unit or may optionally be constructed of several pieces. As a single piece construction, the handles 50 and therapy applicator 30 may be formed integrally with the arcuate member 12. The therapy applicator 30 may be an integral massage point 13 as illustrated in FIG. 2 or it may comprise a selectably interchangeable cartridge 32 as illustrated in FIG. 1 secured to the arcuate member with a latching mechanism as will be further described below.

The arcuate member 12 will have a bow shape with a continuous curvature between the first and second ends 14 and 16 defining a plane. In other embodiments, the arcuate member 12 may have a variable profile in which the curvature is greater proximate to the central portion 18 or proximate to the first and second ends 14 and 16. The arcuate member 12 may sized so as to have a have a chord length as illustrated generally at 17 of between 28 inches (71.1 cm) and 34 inches (86.4 cm) between the first and second ends 14 and 16 with an distance of 30 inches (76.2 cm) being found to be particularly useful. The arcuate member 12 may further have a distance from the chord to the central portion 18 as generally indicated at 19 of between 10 inches (25.4 cm) and 14 inches (35.6 cm) with distance of 12 inches (30.5 cm) being found to be particularly useful. The apparatus 10 may have a distance between the handles 50 of between 31 inches (78.8 cm) and 36 inches (91.5 cm). As Illustrated in FIG. 1, the apparatus may substantially define an arch having end points at the handles 50. Such an arch will have a radius generally indicated at 23 which will be less than 180 degrees so as to ensure that a user may properly grasp the apparatus as described further below such that their hands are not too far from the body nor close together to permit the user to apply pressure to their body with the apparatus without causing undue fatigue to themselves.

The arcuate member 12 may have a generally rectangular cross-section with a side of between ½ inch (1.3 cm) and 2 inches (5.2 cm). In some embodiments, the arcuate member 12 may have an ovaloid cross-section in which the thickness of the arcuate member is greater in a direction perpendicular to a plane defined by the arcuate member. It will be appreciated that other cross-sectional shapes may also be useful as well.

The arcuate member 12 may be formed of a variety of materials such as plastic, wood or metal or any other suitable material as are known in the art. The arcuate member 12 may be formed of materials selected to be non-conductive, rigid and sufficiently strong enough to withstand the forces applide thereto when in use. The arcuate member 12 may contain an electronic/battery storage compartments as will be further described below.

Turning now to FIG. 2, another embodiment is illustrated having removable handles 50. The removable handles 50 comprise a grip 52 secured to the end of an extension shaft 54. The first and second ends 14 and 16 of the arcuate member 12 include blind bores 56 sized to receive the extension shafts 54 therein. The extension shaft 54 is designed to be expandably received within the blind bores 56 in order to permit the apparatus 10 to be adapted to fit a variety of arm lengths of the user and for use in different positions. The extension shaft 54 may be selectably secured within the blind bores 56 by the use of spring-loaded pins and hole latches, latch pins, clamping latches or any other suitable securing means as are known in the art. The distance between the grips 52 will be dependent on the dimensions of the arcuate member 12 and the length of the extension shafts. In some embodiments range of the distance between the grips 52 may be 31 inches (78.8 cm) to 36 inches (91.5 cm).

The extension shaft 54 may have a length of between 3 inches (7.7 cm) and 16 inches (40.7 cm) with a length of 10 inches (5.4 cm) being particularly useful. The extension shaft 54 may also have a bend corresponding to the bend the blind bore 56 in the arcuate member 12, allowing it to maintain the overall shape of the arcuate member in all lengths of extension. The extension shaft 54 may have a variety of cross-sectional profiles including round, oblong, rectangular, square or any other appropriate shape as will be appreciated in the art.

The grips 52 may be rotatably secured to distal ends 58 of the extension shafts 54 such as through the use of bearings or other suitable means by way of non-limiting example. The extension shaft 54 may have a diameter less than the diameter of the grips 52 so as to permit the extension shaft to be rotatably received within the grips 52. The grips 52 may be made in a variety of materials as are commonly known in the art an in a variety of shapes such as by way of non-limiting example, ring shaped, torus shaped or stirrup shaped. The grips 52 have a gripping portion 60 and should be sized to be easily gripped by a user. By way of non-limiting example, the gripping portion 60 may have a circular cross section with diameter of 2 inches (5.1 cm) to 4 inches (10.2 cm). The round gripping portion allows for maximum grip translating to a greater amount of force or leverage to the massage point and also decreases the chance of slippage. The round gripping portion also advantageously allows the unit to more easily rotate as a person moves it from one area of the body to another, making for a more comfortable use of the apparatus.

The apparatus 10 may include an internal electronics and/or battery storage compartments 26 as illustrated in FIG. 2. The storage compartment may range in size due to the cross-sectional dimensions of the arcuate member 12, the battery type or electronics package required by the cartridges 32 and the type of material the arcuate member is constructed from. The energy supplied by a battery within the storage compartment 26 may be provided to the cartridge through the latch as will be further described below.

Figure 3:
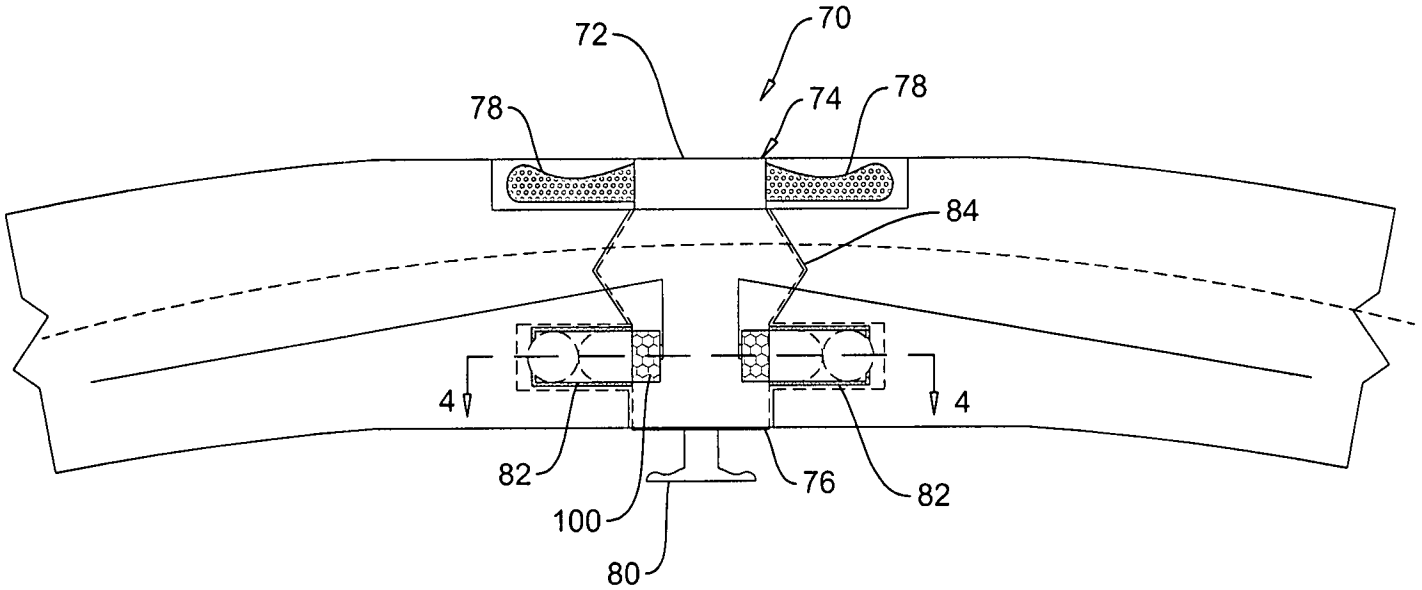
FIG. 3 is a cross sectional view of the latching mechanism of the apparatus of FIG. 1.

The apparatus 10 may have interchangeable cartages 32 and a latching mechanism 70, which is used to secure the cartridges and to provide power from the storage compartment to the interchangeable cartridges 32. The latch mechanism 70 is designed as a rotating-shaft power/locking switch. As illustrated in FIG. 3, the latch mechanism comprises a central shaft 72 having proximate and distal ends, 74 and 76, respectively, oriented perpendicular to the arcuate member 12. The central shaft 72 should be constructed of a non-conductive material. The central shaft 72 has two levers arms 78 extending radially from the proximate end 74 thereof and an engaging lock 80 at the distal end 76 thereof for engaging with and securing the interchangeable cartridge to the arcuate member. The lever arms 78 are used by the fingers of an individual to twist the mechanism latching mechanism 70 into the latched or unlatched state. Intermediate the proximate and distal ends 74 and 76 of the central shaft, are a pair of opposed conducting arms 82. The conducting arms 82 are adapted to electrically connect the batteries or other electrical power supply in the arcuate member 12 with the interchangeable cartridge 32 when secured to the arcuate member. The central shaft 72 may also be machined with an annular guide 84 in order to retain the central shaft within the arcuate member 12. In other embodiments, the conducting arms 82 are also adapted to retain the interchangeable cartridge 32 on the arcuate member.

Figure 4:
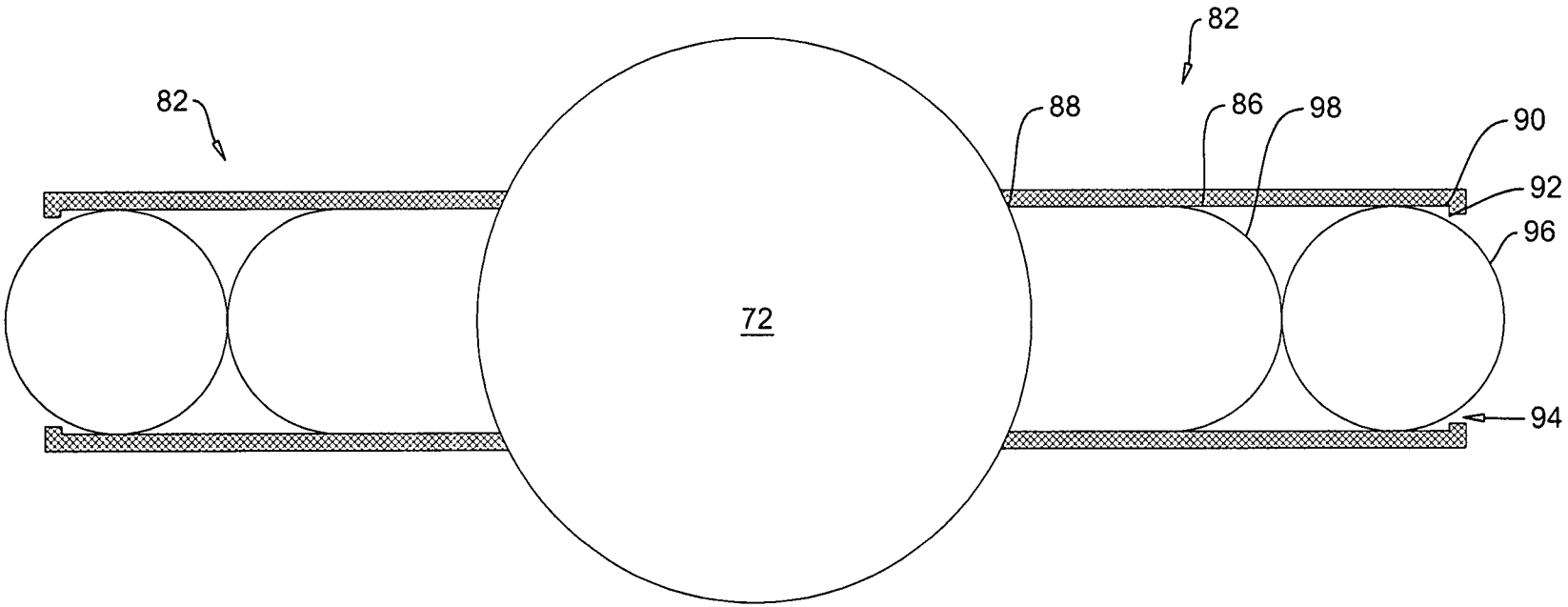
FIG. 4 is a cross sectional view of the conducting arms of the latching mechanism of FIG. 3 taken along the line 4-4.

As illustrated in FIG. 4, the conducting arms 82 are comprised of a shaft tube 86 formed of a conductive material, such as, for example, mild or stainless steel, aluminum or copper and having distal and proximate ends, 88 and 90, respectively. The proximate end 88 is secured to the central shaft 72 while the distal end includes an inner annular collar 92 defining an end bore 94. A conductive body 96 is received within the shaft tube 86 and retained therein by the collar 92. As illustrated, the conductive body 96 may be spherical. A spring 98 is biased within the shaft tube 86 so as to urge the conductive body 96 to the distal end 90 of the shaft tube 86. The spring 98 may be a coiled, mini-strut spring or of any other suitable type know in the art. As illustrated in FIG. 3, the central shaft 72 also includes conducive strips 100 applied circumferentially around extending from the conducting arms 82. The conductive strips may extend a distance sufficient to engage with electrical contacts in the arcuate member as will be further described below. In practice it has been found that extending the conductive strip approximately ¼ of the circumference of the central shaft has been sufficient although other distances will also be useful.

Figure 5:
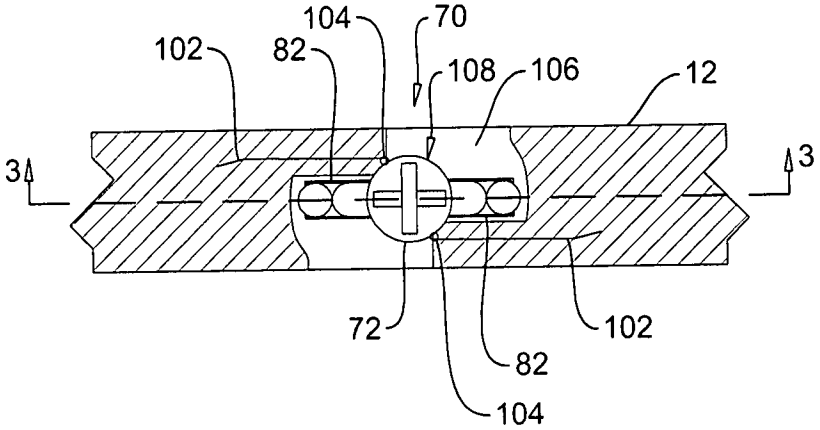
FIG. 5 is a cross sectional view of the latching mechanism of FIG. 1 taken along the line 5-5 with the latch unlocked.
Figure 6:
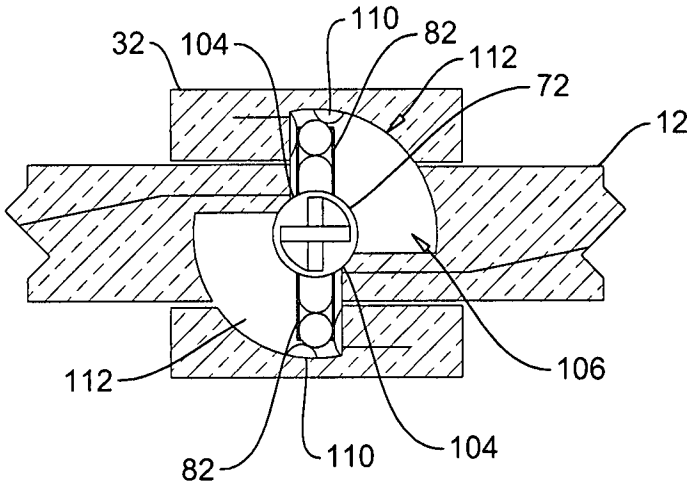
FIG. 6 is a cross sectional view of the latching mechanism of FIG. 1 taken along the line 5-5 with the latch locked.
Figure 7:
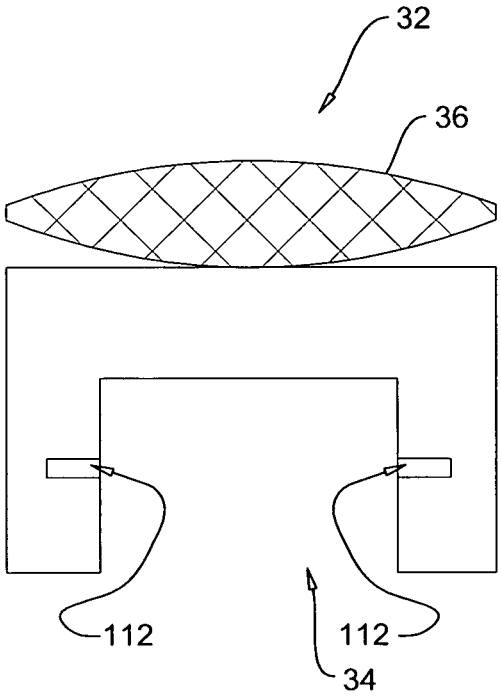
FIG. 7 is an end view of a massage cartridge according to a first embodiment.

Turning now to FIGS. 5 and 6, the latching mechanism 70 is illustrated along a plane perpendicular to the central shaft 72. The arcuate member 12 includes a cavity 106 having a bore 108 therein sized and shaped to receive the central shaft 72 wherein the cavity is further sized and shaped to receive the lever arms 78 and conducting arms 82. The cavity 106 may be shaped to permit the central shaft 72 to be rotated a desired amount, such as for example 90 degrees. The cavity 106 includes electrical contacts 104 within the bore 108 so as to be in contact with the central shaft 72. The electrical contacts 104 are positioned so as to make electrical connection with the conductive strip 100 when the central shaft 72 is rotated such that the conducting arms 82 extend from the arcuate member 12 so as to engage an interchangeable cartridge applied therearound. The cartridge 32 may include a slot 112 to receive the distal ends 90 of the conducting arms and a raised portion 110 to engage the conductive body 96 and retain the conducting arms therein in a locked position. In the locked position, the electrical contacts 104 are in contact with the conductive strips 100 and each of the conducting arms 82 or the conductive body 98 are in contact with a corresponding contact within the cartridge 32. The cartridges may have different uses for the power, ranging from a vibration motor, a heater element, light source to any combination of the three. Accordingly, electricity from the elongate body 12 as conducted by power wires 102 is conducted through the electrical contacts 104, the conductive strips 100, the shaft tube 86, the conductive body 96 and to the cartridge so as to supply electrical power thereto.

Figure 8:
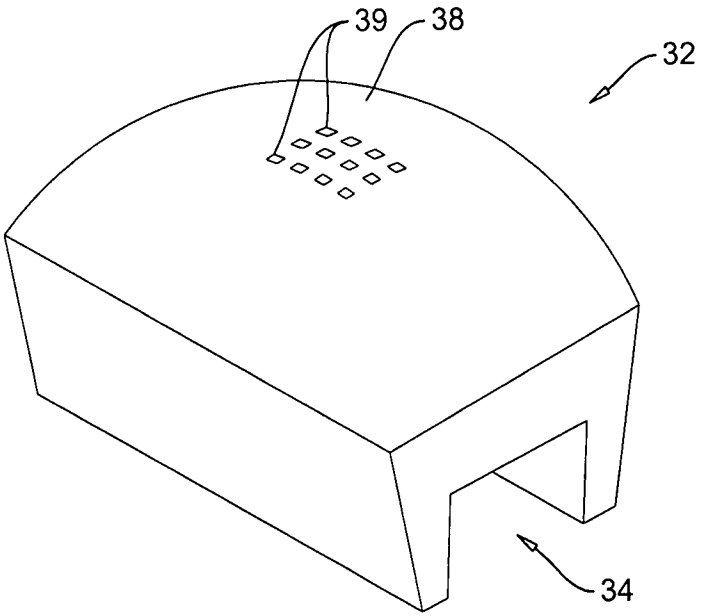
FIG. 8 is a perspective view of a massage cartridge according to a further embodiment.
Figure 9:
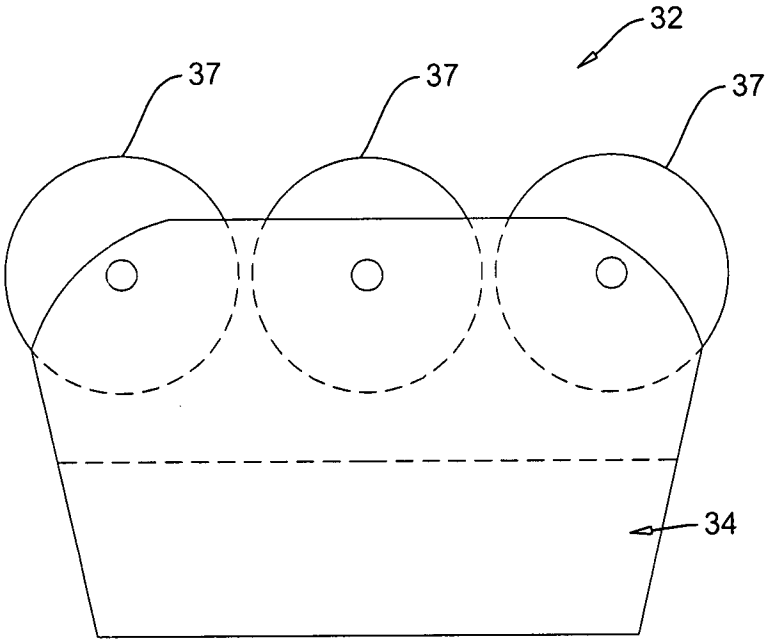
FIG. 9 is a side view of a massage cartridge according to a further embodiment.
Figure 10:
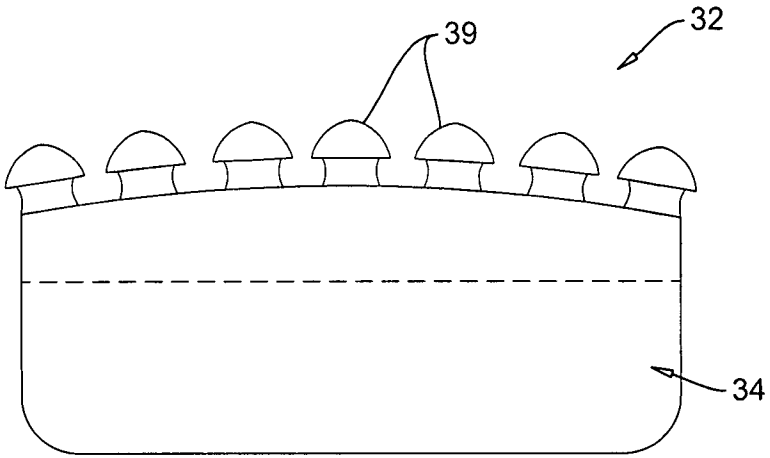
FIG. 10 is a side view of a massage cartridge according to a further embodiment.
Figure 11A:
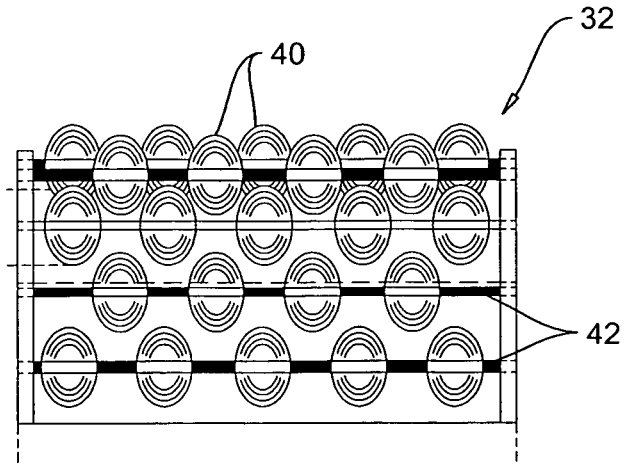
FIG. 11*a* is a side view of a massage cartridge according to a further embodiment.
Figure 11B:
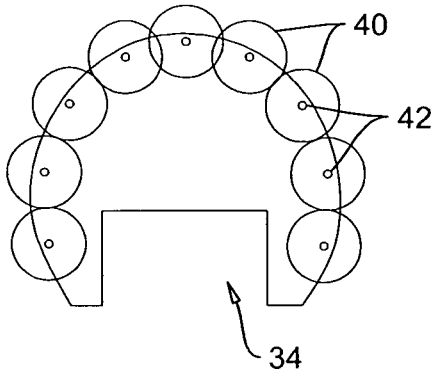
FIG. 11*b* is an end view of a massage cartridge of FIG. 11*a*.

With reference to FIGS. 7 through 11*b*, the cartridge 32 includes a central passage 34 to be received upon the arcuate member. The central passage 34 includes the slots 112 as described above for securing the cartridge thereon. The cartridge 32 will be secured to the arcuate member 12 such that a bearing surface 36 is oriented towards the user when they are grasping the handles. The cartridge may optionally include its own power source in place of the electrical contacts within the latching mechanism 70. The cartridge 32 may be sized to suit the preferences of the user and may incorporate any known type of massage or vibration bearing surface as are known in the art. By way of non-limiting example, the bearing surface may comprise a plurality of rollers 37 as illustrated in FIG. 9, a single curved massage point 38 having very gradual radius to create a reasonably broad contact point as illustrated in FIG. 8. The curved massage point may optionally include light emitting diodes 39 to provide light and heat to relieve muscle strain and stress. These LED's can also help to promote blood flow improving healing. The cartridge 32 may also have multiple stimulation points 39 as illustrated in FIG. 10 or a plurality of rollers, or wheels 40 on a common parallel shafts 42, as illustrated in FIGS. 11*a* and 11*b*. The shafts 42 may also be arranged in a circular array so as to fit into the curves of the neck and provide relaxation massages by rotating the apparatus up and down thereon. It will also be appreciated that the may have such bearing surfaces such as a backscratcher, a loofa sponge to be used in the shower or bath or a massage point.

Figure 12A:
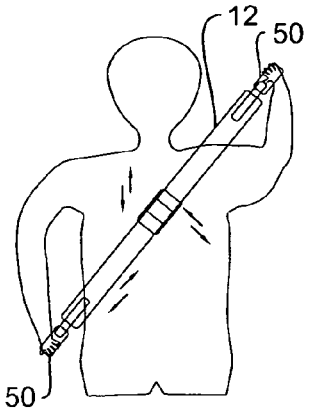
FIG. 12*a* is a rear view of a user applying the apparatus of FIG. 1 to their a first part of their back.
Figure 12C:
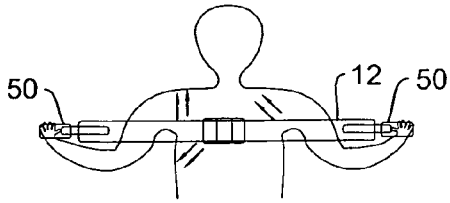
FIG. 12*c* is a rear view of a user applying the apparatus of FIG. 1 to their a further part of their back.
Figure 12B:
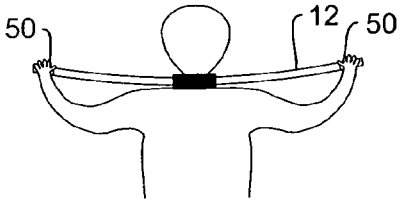
FIG. 12*b* is a rear view of a user applying the apparatus to their neck.
Figure 12D:
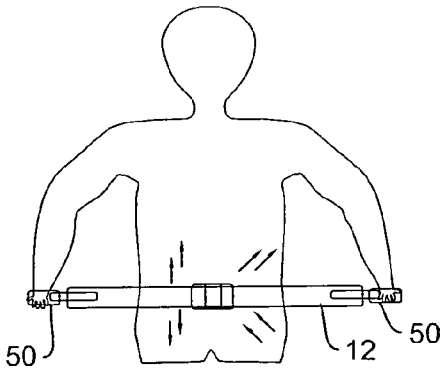
FIG. 12*d* is a rear view of a user applying the apparatus of FIG. 1 to their a further part of their back.

In operation, a user may grasp the handles 50 of the apparatus 10 with the arcuate member behind the back of the user. As illustrated in FIG. 12*a*, the user may grasp the apparatus with one handle above their shoulders and one handle proximate to their waist. As illustrated in FIG. 12*b*, the user grasp the apparatus with both handles above their shoulders to massage their neck. As illustrated in FIG. 12*c*, the user may grasp the apparatus 10 with both handles 50 proximate to their shoulders so as to massage between their shoulder blades. As illustrated in FIG. 12*d*, the user may grasp the apparatus 10 with both handles 50 proximate to their waist so as to massage their lower back. In any of the above positions, the user may then move the apparatus 10 around on their back so as to provide the desired amount and type of massage to that part of their body.

While specific embodiments of the invention have been described and illustrated, such embodiments should be considered illustrative of the invention only and not as limiting the invention as construed in accordance with the accompanying claims.

What is claimed is:

1. An apparatus for massaging the body of a user, the apparatus comprising:

a single rigid arcuate member extending between first and second opposed ends having bores therein and a central portion therebetween wherein said first and second ends are oriented away from said central portion, said arcuate member defining an arc having an angle of less than 180 degrees; handles selectably connected to said first and second opposed ends, said handles having shafts extending therefrom located within said bores;

and a therapy applicator connectable to said central portion.

2. The apparatus of claim 1 wherein said arcuate member comprises an arcuate member having a rectangular cross-section.

3. The apparatus of claim 2 wherein said arcuate member is bow shaped.

4. The apparatus of claim 1 wherein said gripping portions comprise handles selectably connectable to said first and second ends.

5. The apparatus of claim 4 wherein said handles extend axially from said first and second ends.

6. The apparatus of claim 5 wherein said handles are rotatably connectable to said first and second ends.

7. The apparatus of claim 1 wherein said handles are proximate to said first and second ends when said shafts are secured within said bores.

8. The apparatus of claim 1 wherein said shafts extend said handles away from said first and second ends.

9. The apparatus of claim 1 wherein said therapy applicator comprises a cartridge selectably securable to said central portion.

10. The apparatus of claim 9 wherein said cartridge is operable to apply at least one of heat, vibration and light to the body of a user.

11. The apparatus of claim 10 wherein said cartridge includes an electric heater.

12. The apparatus of claim 10 wherein said cartridge includes an electrically driven vibrator.

13. The apparatus of claim 10 wherein said cartridge includes at least one light emitting diode.

14. The apparatus of claim 9 wherein said arcuate member includes a latching mechanism at said central portion operable to cooperate with a corresponding latch on said cartridge.

* * * * *